US008496108B2

(12) United States Patent
Bahcall

(10) Patent No.: US 8,496,108 B2
(45) Date of Patent: Jul. 30, 2013

(54) SINGLE-USE BODY WASHING SYSTEM

(75) Inventor: James Bahcall, Buffalo Grove, IL (US)

(73) Assignee: Paper Shower LLC, Lincolnshire, IL (US)

( * ) Notice: Subject to any disclaimer, the term of this patent is extended or adjusted under 35 U.S.C. 154(b) by 53 days.

(21) Appl. No.: 13/031,307

(22) Filed: Feb. 21, 2011

(65) Prior Publication Data

US 2011/0308992 A1 Dec. 22, 2011

Related U.S. Application Data

(60) Provisional application No. 61/357,384, filed on Jun. 22, 2010.

(51) Int. Cl.
*B65D 81/24* (2006.01)
*B65D 73/00* (2006.01)
*A01N 25/34* (2006.01)

(52) U.S. Cl.
USPC ..... 206/210; 206/459.5; 206/494; 206/581; 206/812

(58) Field of Classification Search
USPC ..... 206/210, 233, 449, 494, 581, 812, 206/459.5; 383/38–40; 424/402, 404
See application file for complete search history.

(56) References Cited

U.S. PATENT DOCUMENTS 4,372,447 A * 2/1983 Miller ..... 206/210
4,420,080 A * 12/1983 Nakamura ..... 206/449
4,702,378 A 10/1987 Finkel et al.
4,749,080 A * 6/1988 Toohey ..... 206/210
4,796,751 A * 1/1989 Madkour ..... 206/494
4,946,033 A 8/1990 Conner
4,998,984 A * 3/1991 McClendon ..... 206/494
5,335,478 A 8/1994 Aronsen
5,409,116 A * 4/1995 Aronsen ..... 206/494
5,464,096 A * 11/1995 Hurwitz ..... 206/494
5,524,764 A * 6/1996 Kaufman et al. ..... 206/581
5,639,532 A 6/1997 Wells
5,803,249 A 9/1998 Harsanyi, Jr. et al.
5,971,138 A * 10/1999 Soughan ..... 206/210
6,189,730 B1 2/2001 McClymonds
6,289,889 B1 9/2001 Bell
6,446,795 B1 * 9/2002 Allen et al. ..... 206/210
6,641,826 B2 * 11/2003 Durden ..... 424/402
6,899,250 B2 5/2005 FitzSimons et al.
7,185,761 B2 * 3/2007 Molina et al. ..... 206/494
7,228,968 B1 * 6/2007 Burgess ..... 206/494
7,682,347 B2 * 3/2010 Parks et al. ..... 206/210
7,694,818 B2 * 4/2010 Molina et al. ..... 206/494
7,699,166 B2 * 4/2010 Gauger et al. ..... 206/494
8,069,988 B2 * 12/2011 Snell ..... 206/494

(Continued)

OTHER PUBLICATIONS

Admitted prior art: Webpages from Amazon.com, Kenz XXL Shower in a Towel.

(Continued)

*Primary Examiner* — Bryon Gehman
(74) *Attorney, Agent, or Firm* — Boyle Fredrickson S.C.

(57) ABSTRACT

A body washing system provides an integrated single-use package co-locating a moist towelette and a dry towelette, the latter sized and design to permit drying of an individual after applying the moist towelette to his or her body in a washing process. The compact size and availability of the dry towelette substantially increases at the availability of bathing systems to individuals to whom conventional bathing or showering is inaccessible.

9 Claims, 3 Drawing Sheets

U.S. PATENT DOCUMENTS

| | | | | |
|---|---|---|---|---|
| 2001/0035416 | A1* | 11/2001 | Dodson | 206/459.5 |
| 2005/0167315 | A1* | 8/2005 | Krey | 206/494 |
| 2009/0050504 | A1* | 2/2009 | Stechschulte et al. | 206/459.5 |

OTHER PUBLICATIONS

Admitted prior art: Webpages from Amazon.com, No Rinse Bathing Wipes.

Admitted prior art: Webpages from Amazon.com, Nathan Power Shower Refreshing Body Wipes.

Admitted prior art: Webpages from Amazon.com, Wet and Dry Cleaning Towelettes, 20 sets/pack.

Admitted prior art: Webpage from Amazon.com, LA Fresh Screen Cleaning Towelettes.

* cited by examiner

SINGLE-USE BODY WASHING SYSTEM

CROSS-REFERENCE TO RELATED APPLICATION

This application claims the benefit of U.S. provisional application 61/357,384 filed Jun. 22, 2010 and hereby incorporated by reference.

BACKGROUND OF THE INVENTION

The present invention relates to a method and apparatus for body cleansing when conventional bathing facilities are not available or practical.

Active individuals, for example, those commuting to work by jogging or using a bicycle, are often hampered by the lack of showering or bathing facilities at their destination. Individuals involved in outdoor activities such as a picnic or beach going, may have a need to freshen up before a subsequent party or social gathering. Travelers, and especially business travelers taking extended trips to meet with clients or business associates, may face a similar dilemma.

Large area pre-moistened towelettes (for example 2'×4') in single-use foil packages are generally known in the art for campers or the like who do not have access to plumbing. Such wipes are relatively bulky, and are an imperfect solution to those who may not have the luxury of time for substantial air-drying outdoors, or access to a separate dry towel or clothing, or a clean or private space in which to wash. Some pre-moistened towelettes incorporate substantial alcohol content into the moistening material to promote rapid drying. High proportions of alcohol may not be practical for a body washing system where large areas of skin will be moistened.

SUMMARY OF THE INVENTION

The present inventor has recognized that the simple co-location of a dry towelette with a moist towelette in a single-use package can substantially increase the accessibility of a single-use body washing system to active individuals. By providing a dry towelette properly sized to provide a substantially complete drying of the individual after use of the moist towelette, the area washed and the amount of moisture used in the bathing process can be substantially increased to approximate more closely an actual bath or shower. Additional toiletry items can be incorporated in an analogous manner.

Specifically then, the present invention provides a body washing system having a moist towelette sealed in a first moisture impervious package openable by tearing the packaging material of the first package, the first moisture impervious package attached to a second moisture impervious package openable by tearing the packaging material of the second package and holding a dry towelette therein.

It is thus a feature of at least one embodiment of the invention to provide an integrated package providing a bathing experience commensurate with being able to apply sufficient moisture to a large enough area of the body requiring subsequent moisture removal by a towelette. It is another feature of a least one embodiment of the invention to provide a system that is lightweight and sufficiently convenient to be practically available to individuals in a variety of situations.

The first and second moisture impervious packages may be joined by a common seam in packaging material extending between the first and second packages.

It is thus a feature of at least one embodiment of the invention to provide a packaging system that may make use of well-established packaging technologies.

The seam may be perforated.

It is thus a feature of at least one embodiment of the invention to permit the user the option of separating the packages for more convenient access.

The seam may include a tear notch promoting tearing of the material of the first and second packages at the tear notch.

It is thus a feature of at least one embodiment of the invention to present a tear notch that promotes a logical sequential opening of the packages in order of use.

The body washing system of claim 1 wherein the material is heat-sealable polymer and foil laminate.

It is thus a feature of at least one embodiment of the invention to provide easily openable packaging that preserves the hygienic qualities of the bathing materials.

The moist and dry towelettes have may have an area greater than 300 square centimeters.

It is thus a feature of at least one embodiment of the invention to provide a body cleaning system suitable for full body bathing.

The moist and dry towelette may be nonwoven.

It is thus a feature of at least one embodiment of the invention to provide material that has suitable strength for cleaning and that provides significant capillary adsorption capabilities for both holding a moistening liquid and removing the same.

The first package may have indicia indicating moisture and the second package has indicia indicating dryness.

It is thus a feature of at least one embodiment of the invention to both inform the consumer of the nature of the product while providing guidance as to the contained elements. This specificity of labeling is possible by packaging each towelette in separate outer package material.

The first and second moisture impervious packages may be joined at a common sealed edge of shared material and folded over each other along the common sealed edge to bring opposed edges of each package displaced from the common edge together in attachment.

It is thus a feature of at least one embodiment of the invention to provide a compact, single-use wet/dry product without the need for special or bulky container design.

The attachment of the opposed edges may be by means of an adhesive applied to the packaging such as a thermoplastic space-filling adhesive.

It is thus a feature of at least one embodiment of the invention to provide a simple method of producing a dual compartment package using conventional heat-sealed pouches suitable for mass production with current technologies.

The body washing system may include one or more additional moisture impervious packages releasably attached to one of the first and second moisture impervious packages and holding a third towelette supporting a material different from moistening materials of the first towelette.

It is thus a feature of at least one embodiment of the invention to provide a more complete body washing experience by co-locating material selected from the group consisting of: sunscreen, insect repellent, deodorant, anti-perspirant, and hair conditioner.

The body washing system may further include a hang-tag attached to at least one of the first and second packages providing a hole for suspending the package on a peg.

It is thus a feature of at least one embodiment of the invention to permit improved retail display and/or use of the product when clean counter space is unavailable.

The second package may contain a third moisture impervious package.

It is thus a feature of at least one embodiment of the invention to permit other toiletry items to be incorporated into the packages to provide for improved co-location of products. It is a further object of the invention to permit co-location of other types of products needed during bathing such as gels, creams or lozenges.

These particular features and advantages may apply to only some embodiments falling within the claims and thus do not define the scope of the invention.

DETAILED DESCRIPTION OF THE PREFERRED EMBODIMENT

Figure 1A:
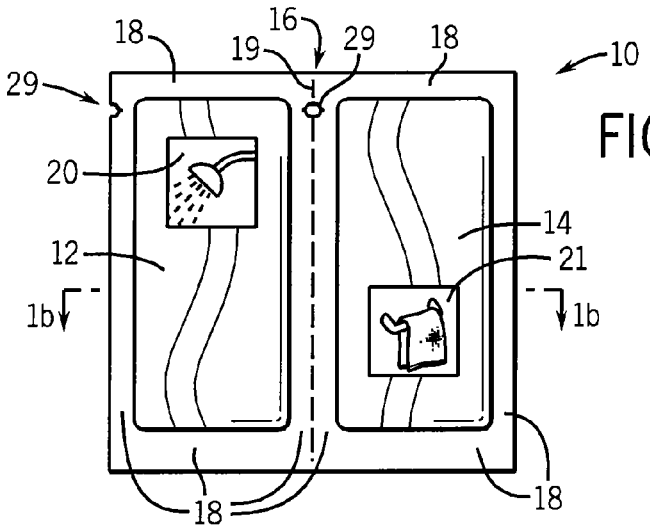
FIG. 1*a* is a front elevational view of a combined package holding a dry and pre-moistened towelette per the present invention.

Referring now to FIG. 1, a body washing system 10 may provide side-by-side tear-packets 12 and 14 joined at a common edge 16. The common edge 16 may have a perforation 19 extending only partially along the length of the common edge 16 between the packets 12 and 14, as will be described below, or fully along common edge 16 to permit complete separation of the packets 12 and 14.

Figure 1B:
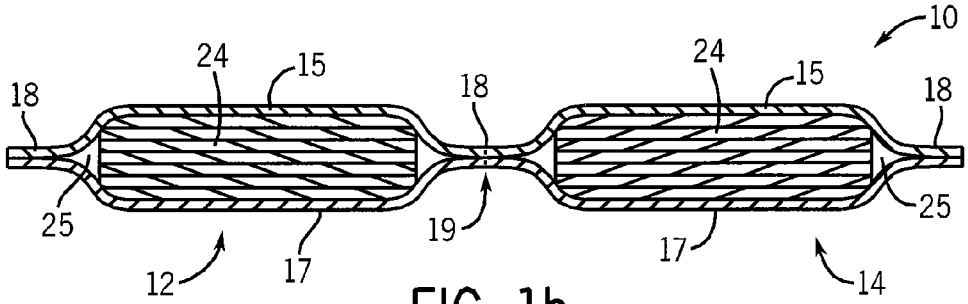
FIG. 1*b* is a cross-sectional view along line 1*b*-1*b* of FIG. 1*a* showing the dry and pre-moistened towelette inside the packages.

Referring also to FIG. 1*b*, tear packet 12 and 14 may comprise a front and rear sheet 15 and 17 sealed around a periphery 18 (for example by heat-sealing which fuses the materials or by adhesives). Each periphery 18 defines a rectangular inner compartment 25 each holding a towelette 24 as will be described below. The front and rear sheet 15 and 17 may, for example, be a laminated polymer and foil material (polymer/foil/polymer) to provide for protection from the environment, an outward printable surface, light and moisture imperviousness, and thermal fusing of the periphery 18.

The packets 12 and 14 may be positioned side-by-side abutting at their longest edges with their peripheries 18 joined at a common edge 16 to provide a continuation of the sheets 15 and 17 between the packets 12 and 14.

One or both of the front or rear sheets 15 and 17 of the packets 12 and 14 may be printed, for example, with product identification information and indicia 20 and 21 indicating the function of a contained towelette 24 within the packets 12 and 14. Preferably, indicia 20 indicate moisture or washing while indicia 21 indicate dryness or drying, for example, as expressed by colors (cool versus warm colors) and/or symbology (water spray versus dry towel on a towel rod).

Figure 2:
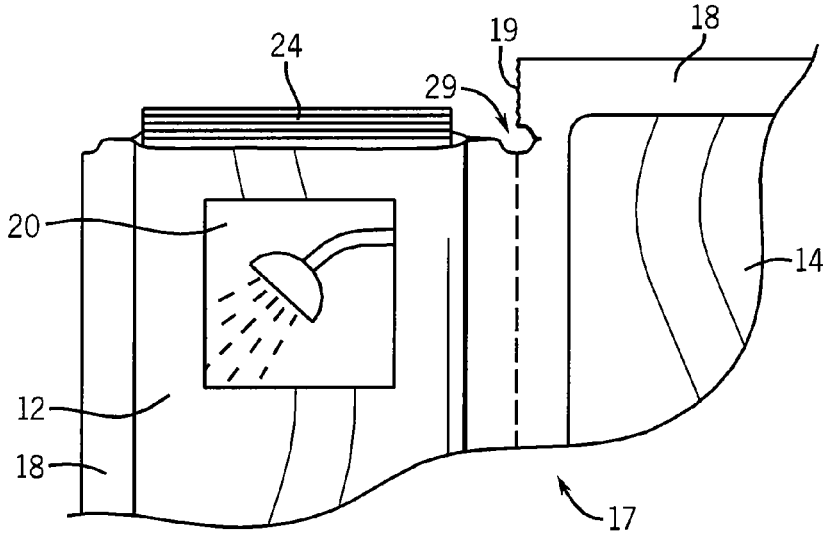
FIG. 2 is a detailed fragmentary view of FIG. 1 showing a tear notch located in the seam between the two packages to permit consistent tear direction and/or to promote a particular ordering of package opening.

Referring also to FIG. 2, packet 12 may contain a moisture impregnated towelette 24 of a material of the type known in the art, for example, a nonwoven material having an area preferably about 9"×11.5" and generally greater than 7"×7" (about 300 square centimeters) and less than 24"×24" in area (about 3600 square centimeters). The towelette 24 may be folded to fit within the dimensions of the packet 12 or 14 having an internal pocket dimension of about 2"×4".

The towelette 24 in packet 12 maybe pre-moistened with a combination of water, surfactant, and small amounts of alcohol to provide for cleaning of the whole body. In one example, the towelette 24 may be pre-moistened with a combination of water, aloe vera, glycerin, sodium coco PG-dimonium chloride phosphate, polyoxyethylene sorbitan monolaurate, urea (2,5-dioxo-4-imidazolidinyl), DMDM hydantoin, benzylammonium chloride, ethanol, and vitamin E.

In addition, the towelette 24 may include menthol or similar compounds to promote a sensory cooling of the individual to reduce perspiration. The size of the towelette 24 will be sufficient to provide adequate moisture and cleaning material to permit washing an individual's entire body.

The packet 14 may include a nonwoven absorbing towelette 26, possibly but not necessarily, of the same material as towelette 24, having an area sufficient to dry the expected moisture remaining on the skin after use of the towelette 24 in packet 12 accounting for some evaporation. In this regard, the towelette 24 in packet 14 is dry without the pre-moistening. Generally, the towelette 24 in packet 14 will have an area identical to that of the towelette 24 in packet 12 for manufacturing convenience. Again, towelette 26 may be folded to fit within the packet 14 of similar size to packet 12. Because the towelette 24 is dry, desiccant materials such as antiperspirants may be included on the towelette 26. Before packaging, the dry towelette 26 may be stored in reduced humidity to provide additional absorbing capabilities. In an alternative embodiment, the dry towelette 26 may be lightly moistened with a hydrophilic material such as alcohol without water to assist in the drying process.

Referring to FIGS. 1 and 2, the outer periphery 18 of the packet 12 may include a starting cut or tear notch 29 to assist the user in tearing open the packet 12. A corresponding notch 29 may be placed spanning or abutting the common edge 16 between the packets 12 and 14 to be accessible as indicated in FIG. 2 only after opening of the packet 12 to promote proper opening order of the towelettes 24 and 26. In one embodiment the perforation 19 extends inward only as far as the tear notch 29 to hold the packets 12 and 14 together for unitary disposal.

Figure 3A:
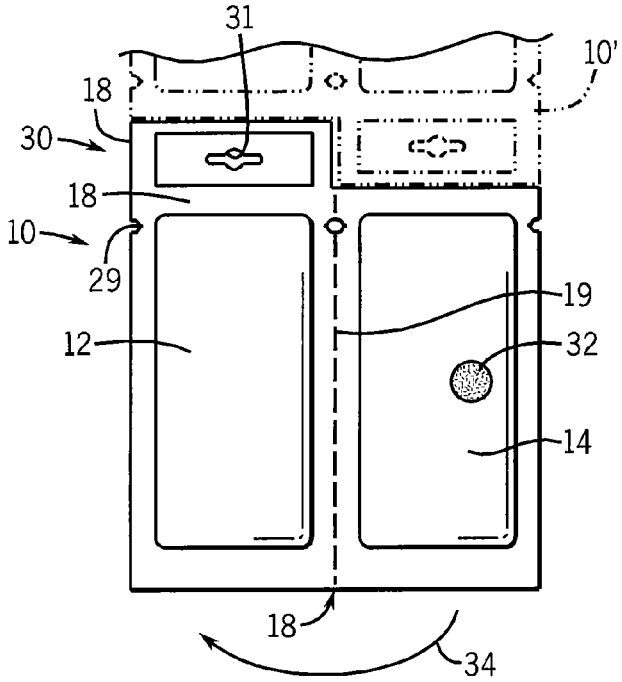
FIG. 3*a* is a front elevational view of an alternative embodiment of the invention providing a hang-tag and shown in an open state and further showing an orientation of adjacent blanks for cutting the material of the packaging.

Referring now to FIG. 3*a*, in an alternative embodiment, or any of the embodiments described herein, a hang-tag 30 may be attached at the upper periphery 18 of one or both of the packets 12 and 14 (shown only attached to packet 12 in FIG. 3*a*). The hang-tag 30 may have an outer periphery 18 of sealed material and may include a central aperture 31 for receiving a peg on a retail display.

Figure 3B:
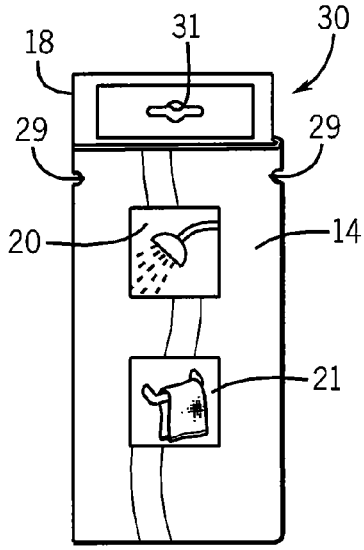
FIG. 3*b* is a figure similar to that of FIG. 3*a* showing a folding of the package of FIG. 3*a* for hang-tag display or use.

An adhesive 32, for example a thermoplastic, space-filling, high-tack adhesive, may be placed on the front of packet 14 which may be folded along the common edge 16 between packets 12 and 14, as shown by arrow 34, so that the adhesive 32 on the front of packet 14 also contacts the front of packet 12 holding them together as shown in FIG. 3*b*. In this folded configuration, the center of gravity of the package is centered beneath the aperture 31 for proper hanging. In this case both of indicia 20 and/or 21 may be printed on the rear face of packet 14 (as oriented per FIG. 3*a*) or separate indicia may be placed as described in FIG. 1 on the rear surfaces of both packets 12 and 14 (as oriented per FIG. 3*a*).

It will be appreciated that the additional material necessary to make the hang-tag 30, such as causes the cut sheets to deviate from a rectangular shape most efficiently prepared from sheet stock, can be readily accommodated by matching mirror rotations of the blanks for production of the system 10 with mirror image blanks for body washing system 10'.

Figure 4:
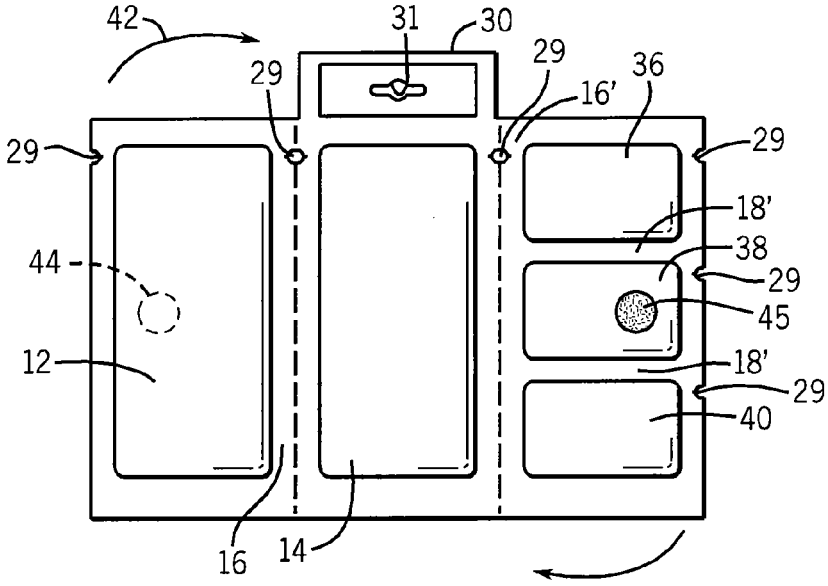
FIG. 4 is an front elevational view of an alternative embodiment of the present invention providing for additional toiletry items in separate co-located pouches.

Referring now to FIG. 4, it will be understood that this concept may be extended to provide for additional sealed packets 36, 38 and 40 attached to one or both of packets 12 and 14. In the depicted example, sealed packets 36, 38 and 40 may each extend one third the height of packets 12 or 14 and may be arranged vertically so that a common vertical edge 16' may be created with the left side (as shown) of packet 14. In this case, the hang-tag 30 may be attached to the upper periphery 18 of packet 14 and the three columns formed by packet 12, packet 14, and the combination of packets 36, 38, and 40 may be zigzag folded with packet 12 folding behind packet 14 as indicated by arrow 42 to be held by adhesive 44 on the rear face of packet 12, and the collection of packets 36, 38 and 40 folded in front of packet 14 and held by adhesive 45 on the front face of packet 38.

Each of packets 36, 38, and 40 may have associated tear notches 29 to allow them to be individually opened. Indicia 20 and 21 may be placed on the rear side of the collection of packets 36, 38 and 40 or the rear side of packet 12 or both.

Packets 36, 38, and 40 may hold, for example, towelettes 24 incorporating sunscreen, insect repellent, deodorant, antiperspirant, toothpaste, skin moisturizer, or hair conditioner. Material suitable for dry hair conditioning is described, for example, in U.S. Pat. No. 4,206,195 issued Jun. 3, 1980 and hereby incorporated by reference. Particularly for the antiperspirant, separation from the moist towelette is required. Material suitable for a towelette holding a toothpaste material is described, for example, in U.S. Pat. No. 6,721,987 issued Apr. 20, 2004 and hereby incorporated by reference.

Figure 5:
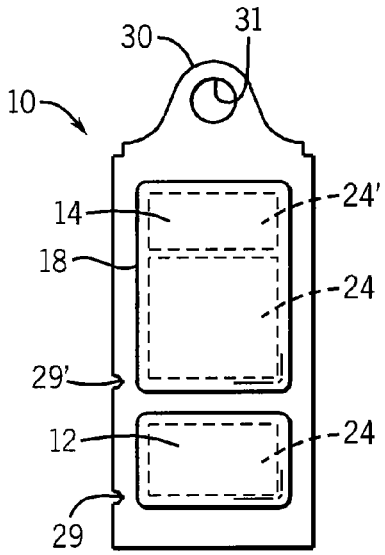
FIG. 5 is a front elevational of view of an alternative embodiment providing vertical rather than side-to-side orientation of the different packages and showing incorporation of two dry elements in a second pouch.

Referring now to FIG. 5, the body washing system 10 may provide for alternative form factors including, for example, mounting packet 14 above packet 12 to a share bottom and top periphery 18 respectively. In this embodiment or any previous embodiment, a third towelette 24' may be provided with, for example, an impregnated deodorant or fragrance material separate from the drying towelette 26. Both towelettes 26 and 24' may be contained within the dry packet 14 or within separate packets extending downward or sideward following the principles described above.

The embodiment of FIG. 5, as discussed above, may provide for a center of gravity vertically aligned with the aperture 31 of the hang-tag 30 within a form factor suitable for such displays. The aperture 31 in the hang-tag 30 alternatively may be enlarged beyond that necessary for retail display to permit the body washing system 10 to hang on a coat hanger, for example, as may be found in the stall of a restroom allowing the product to be used in an airport or the like where privacy is difficult to obtain. In these circumstances, the co-location of the products helps support the different products hygienically on the hang-tag 30 during use. For this purpose, a first tear notch 29 may be provided at the bottom of the body washing system 10 as suspended on the hang-tag 30 providing access to packet 12 allowing the packet 14 to remain suspended and unopened. Upon completion of the body washing operation, a second tear notch 29' may be used to provide access to a drying towelette in packet 14 and a deodorant towelette positioned above that towelette. This staging of the products to exploit support by the hang-tag 30 can be performed with the other described embodiments herein.

Figure 6:
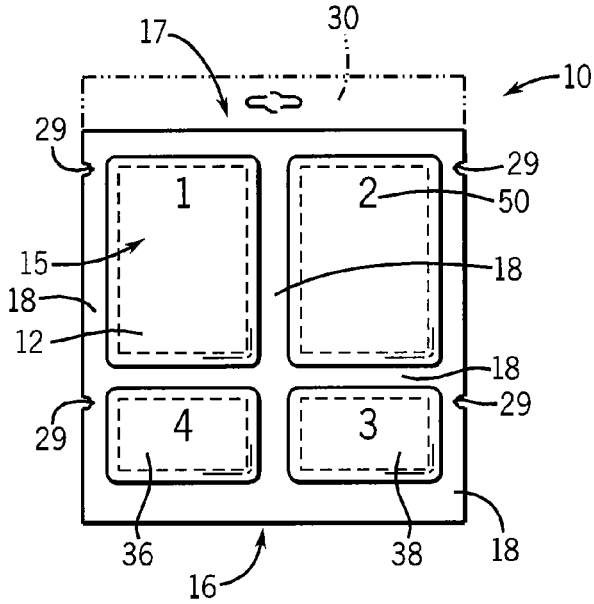
FIG. 6 is a figure similar to that of FIG. 5 showing an alternative arrangement of four packages.

Referring now to FIG. 6, in an alternative embodiment, the body washing system 10 may seal the two sheets 15 and 17 at peripheries 18 to create four packets 12, 14, 36, and 38 with packets 12 and 14 connected side-by-side (as disclosed above) and packets 36 and 38 connected beneath packets 12 and 14 respectively. All packets may be supported beneath an optional hang-tag 30 (in this case spanning the top edges of both packets 12 and 14). This embodiment allows the consumer simultaneously to see the different products incorporated into the single body washing system 10. The proper order of opening of the packets may be indicated by numeric indicia 50 and/or by placing the tear notches 29 to promote a sequential opening, for example, by providing certain tear notches 29 at exposed edges and other tear notches 29 at the common edges 16 accessible only after a previous packet has been opened.

In an alternative embodiment shown, a first tear notch 29 for packet 12 is placed at an outer periphery 18 of packet 12 and second tear notches 29 at outer periphery 18 of packet 14 to preserve the support of the common edge 16 for packets 36 and 38 even after packets 12 and 14 are opened. Likewise, the tear notches 29 at outer peripheries 18 of packets 38 and 36 preserve the common edge 16. This retention of the packets 12, 14, 36, and 38 on a supporting backbone of common edge 16 allows them to be pre-opened for convenience and also simplifies disposal.

Figure 7:
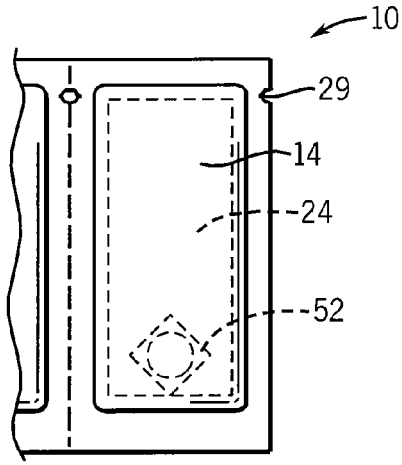
FIG. 7 is a fragmentary detail of FIG. la showing incorporation of a sealed package within one package.

Referring now to FIG. 7, it will be appreciated that the body washing system 10 may further include within a packet, packet 14 for example, both a towelette 24 and a secondary packet 52 independently formed from sealed laminate. The secondary packet 52 and the packets 36, 38 and 40 need not be limited to containing towelettes but may also hold gels, creams, lozenges, for example breath mints or the like, or a trash disposal bag.

It will be understood that the present invention may use other packaging techniques other than the tear-packets described above, for example sealing the packages with adhesive or a polymer zipper and/or with a tear strip to permit re-sealing of one or both of the packets 12 and 14 for disposal of the towelette 24 and 26 or the like.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. A body washing system comprising:

a first moisture impervious package adapted to be openable only by tearing a packaging material of the first package, the first moisture impervious package further holding only a single moist towelette being a substantially continuous nonwoven folded sheet sealed therein the moist towelette providing a moistening material comprising a combination of water and aloe vera;

a second moisture impervious package attached to the first moisture impervious package, the second moisture impervious package adapted to be openable only by tearing the packaging material of the second package and the second moisture impervious package containing only a single dry towelette being a substantially continuous nonwoven folded sheet sealed therein wherein the moist and dry towelettes each have an area greater than 300 square centimeters;

wherein the first and second moisture impervious packages are formed of a heat-sealable polymer and foil laminate and are joined by a common seam extending between the first and second packages; and wherein the first package has graphical indicia providing a symbol denoting moisture and the first package is of a first color indicating cool and the second package has graphical indicia denoting dryness and of a second color indicating warmer than the first color dryness.

2. The body washing system of claim 1 wherein the first and second moisture impervious packages are joined at a common sealed edge of shared and common packaging material and folded over each other along the common sealed edge to bring opposed edges of each package opposed to the common edge together in attachment.

3. The body washing system of claim 2 wherein the attachment of the opposed edges is by means of an adhesive applied to the shared and common packaging material.

4. The body washing system of claim 3 wherein the adhesive is thermoplastic space filling adhesive.

5. The body washing system of claim 1 further including a hang-tag attached to at least one of the first and second packages providing a hole for suspending the first moisture impervious package and second moisture impervious package on a peg.

6. The body washing system of claim 1 wherein the second package contains a third moisture impervious package.

7. The body washing system of claim 6 wherein the third moisture impervious package holds a material selected from the group consisting of:

a gel, cream and a lozenge.

8. A body washing system comprising:

a first moisture impervious package adapted to be openable by tearing a packaging material of the first package, the first moisture impervious package further holding only a single moist towelette containing moistening material and being a substantially continuous nonwoven folded sheet sealed therein;

a second moisture impervious package attached to the first moisture impervious package, the second moisture impervious package adapted to be openable by tearing the packaging material of the second package and the second moisture impervious package containing only a single dry towelette being a substantially continuous nonwoven folded sheet sealed therein wherein the moist and dry towelettes each have an area greater than 300 square centimeters ;

further including a third moisture impervious package releasably attached to one of the first and second moisture impervious packages and holding a third towelette supporting a material different from the moistening material of the first towelette;

wherein the third towelette includes material selected from the group consisting of: sunscreen, insect repellent, deodorant, anti-perspirant, and hair conditioner.

9. The body washing system of claim 8 further including a third and fourth towelette having different materials selected from the group consisting of: sunscreen, insect repellent, deodorant, anti-perspirant, and hair conditioner.

* * * * *